US005667025A

United States Patent [19]

Haessly et al.

[11] Patent Number: 5,667,025

[45] Date of Patent: Sep. 16, 1997

[54] ARTICULATED BIT-SELECTOR CORING TOOL

[75] Inventors: John G. Haessly, Spring; Duane F. LaDue, Sugar Land, both of Tex.

[73] Assignee: Schlumberger Technology Corporation, Houston, Tex.

[21] Appl. No.: 536,720

[22] Filed: Sep. 29, 1995

[51] Int. Cl.[6] ..... E21B 25/02

[52] U.S. Cl. ..... 175/78; 175/249

[58] Field of Search ..... 175/20, 52, 78, 175/249, 251, 403, 404

[56] References Cited

U.S. PATENT DOCUMENTS

| | | | |
|---|---|---|---|
| 4,354,558 | 10/1982 | Jageler et al. . | |
| 4,449,593 | 5/1984 | Jageler et al. . | |
| 4,461,360 | 7/1984 | Mount III . | |
| 4,466,495 | 8/1984 | Jageler . | |
| 4,714,119 | 12/1987 | Hebert et al. . | |
| 5,163,522 | 11/1992 | Eaton et al. . | |
| 5,310,013 | 5/1994 | Kishino et al. . | |
| 5,411,106 | 5/1995 | Maissa et al. | 175/78 |
| 5,445,228 | 8/1995 | Rathmell et al. | 175/44 X |
| 5,487,433 | 1/1996 | Mackay et al. | 175/78 |

FOREIGN PATENT DOCUMENTS 2 283 261 5/1995 United Kingdom .

*Primary Examiner*—William P. Neuder
*Attorney, Agent, or Firm*—Darcell Walker; John J. Ryberg

[57] ABSTRACT

A multiple coring bit tool and method for taking multiple core samples of a formation traversed by a borehole in one well logging run. In this tool, multiple coring bits are used to cut the core samples. One bit is used to cut each sample. Once the core sample has been taken, the cutting bit containing the core sample is stored. For the next core, a new cutting bit is used and that cutting bit contains that core sample once the coring process is completed. Multiple cutting bits are held in two or more chambers prior to use in the coring process. The bits in one chamber are used to cut core samples from formation location above a certain hardness and the bits in the second chamber are used to cut cores in formations below a certain harness. Two other chamber are incorporated in the tool for storage of the cutting bits once the core sample has been obtained. The sequence of the sample is tracked thereby permitting the identification of any core sample and the location in the formation from which the core sample was taken.

52 Claims, 10 Drawing Sheets

ARTICULATED BIT-SELECTOR CORING TOOL

FIELD OF THE INVENTION

The subject matter of the present invention relates to an apparatus and method for taking core samples from a subterranean formation, and in particular it relates to an apparatus and method for taking multiple samples during a single borehole run using multiple cutting bits. The appropriate bit for taking a particular core sample being selected from a plurality of cutting bits.

BACKGROUND OF THE INVENTION

Coring is the process of taking a core sample from a subterranean formation. For many years, geologists in the oil and gas exploration industry have taken and analyzed core samples of potential hydrocarbon-producing formations as part of their efforts to determine the profitability of completing wells in formations from which the core samples are taken. Several types of coring techniques are used to take a core sample from a well traversing a subterranean formation including: a) conventional, (b) diamond, (c) wireline and (d) sidewall coring techniques. Before coring occurs, the borehole fluid is circulated to remove carvings and loose material. The conventional and diamond cores are taken with a core barrel and drillstring. Wireline coring is a method of coring a well without tripping in and out with the drillstring. The core is raised by the wireline in a re-tractable core barrel inside the drillstring. The cores range up to 15 feet (4.57 meters) in length and between 1⅛ to 2½ inches (2.85 to 6.35 centimeters) in diameter. In sidewall coring, a small core is taken from the sidewall of a borehole by a sidewall coring tool or gun after the well has been drilled. The cores are used to verify the lithology of formations seen on electronic logs and to sample the fluids present in the formation. Grain shattering is common in the sample. The fracturing of tight rocks tends to increase their porosity and permeability, whereas the compaction of soft rock tends to decrease their porosity and permeability.

Sidewall cores are relatively inexpensive and are used primarily in exploration wells. In these coring methods, less weight is applied to the bit during coring than during drilling, and a slower rotary speed is used in the coring process. The core is broken off in the core barrel and then retrieved and placed in trays, labeled, inspected, and described on the rig floor. The core is wrapped, sealed and sent to the laboratory. Coring is generally expensive because it involves rig time.

One problem with coring tools in exploratory wells is the lack of knowledge of the exact location of the formation of interest, or "pay zone," with respect to well depth. In many instances, drillers have unintentionally drilled completely through the pay zone or target formation without taking any core samples because the pay zone was at a slightly lesser depth than anticipated. Since logging tools can be run into a borehole before it is cased and cemented to determine the location or locations of potential pay zones, coring of these promising zones subsequent to drilling and identification thereof via open-hole logging of the borehole provides a means to verify and enhance the information on production potential provided by seismic surveys and well logs. For obvious reasons, the only economic way to take core samples from a drilled borehole is from its sidewall.

Sidewall coring tools are used to cut and retrieve several cylindrical cores from the bore hole for laboratory analysis of formation properties. These tools shoot or punch sample cups into the sidewall of the borehole perpendicular to the borehole axis and retrieve the cups when the tool is retrieved. Alternatively, coring tools have been employed which drill cores perpendicular to the borehole. Both types of tools are limited to an extremely small diameter and consequently produce very short cores which do not provide an adequate amount of formation to analyze and which may therefore not be representative of the target formation characteristics. In addition, such tools often cause damage to the formation by their operation.

Conventional sidewall coring tools usually employ only one cutting bit that may be able to cut a maximum of 50 cores. After the core is cut, each core is forced out of the bit by a ram into a core holding chamber. A spacer or marker is then dropped on top of the core to identify the sequence and the depth at which the core was removed. Although this system obtains cores in the field, there are some major problems with this system. The main problem occurs when the bit fails to obtain a core. This situation occurs while coring in a washout or if the ramming device fragmented the core during extraction. When this happens, the marker would then fall on top of the previous marker making identification of core depth difficult. Another problem arises from the use of only one bit to cut all the cores. After about 30 cores, the bit begins to wear significantly and the teeth start to clog with debris. The worn bit and debris substantially reduces the efficiency of the coring tool.

The existing sidewall coring tools do not adequately address the current needs associated with sidewall coring. U.S. Pat. No. 4,354,558 discloses a sidewall coring tool that can cut and store multiple coring samples in a single borehole run. However, only a maximum of eight cores can be stored. Furthermore, each cutting bit stores two core samples. This technique can lead to a contamination of the two samples being stored in each core barrel. U.S. Pat. No. 4,466,495 discloses a method to take a core sample and maintain the sample at the formation pressure. U.S. Pat. No. 4,449,593 describes another conventional sidewall coring tool. In this patent, the cut core sample is forced from the core barrel into a core container. This technique can have problems with indexing the core sample and with core contamination. U.S. Pat. No. 4,461,360 only describes an apparatus to extend and guide a cutting bit.

Although there are sidewall coring tools, there still remains a need for an improved coring tool that is more reliable and can take multiple core samples of various formation hardnesses in a single borehole run.

SUMMARY OF THE INVENTION

It is an object of the present invention to increase the number of core samples that can be taken in one borehole run.

It is also an object of this invention to provide an improved method of identifying core samples.

It is another object of this invention to provide an improved method of determining core orientation.

It is another object of this invention to provide a means of selecting a drill bit based on the hardness of the formation, from a plurality of drill bits during the borehole run.

The present invention incorporates multiple cutting bits instead of a single cutting bit. These cutting bits are loaded into a plurality of separate holding chambers. Each holding chamber contains an indexing means which precisely indexes each bit upward to the top of the chamber and into a ready position for use in the coring process. At this point, the indexed drill bit is positioned and aligned such that the bit is in front of a drilling device usually a gear drive. The gear drive, which supplies the force and the spin rotation needed for the cutting action of the drill bit, moves toward the rear of the bit and engages it. After the gear drive engages the drill bit, the gear drive builds up to full power while it continues to move forward thereby cutting a core out of the formation. After cutting and breaking the core in the formation, the gear drive moves back to its original position. The drill bit containing the core is then re-engaged and positioned such that the drill bit can be stored in a storage chamber. The loaded drill bit is rotated and aligned with a storage chamber. After the alignment, the bit is released into a secure storage chamber.

This multiple core bit system solves the problem of core identification since each core is contained in its own cutting bit and is checked to be sure a core was obtained at the depth. No additional marking system is needed. Since there is no need of a core pusher, the core quality is better preserved and the use of multiple bits also provides for more efficient coring from first to last core because a fresh bit is used for each core.

Core orientation (identifying the upper from the lower rock strata on the core as taken from the formation) is possible with this design because all the bits are keyed to a fixed angularity with respect to each other when engaged by the gear drive and the core breaks can be done consistently at that same angularity.

DESCRIPTION OF THE PREFERRED EMBODIMENT

Figure 1:
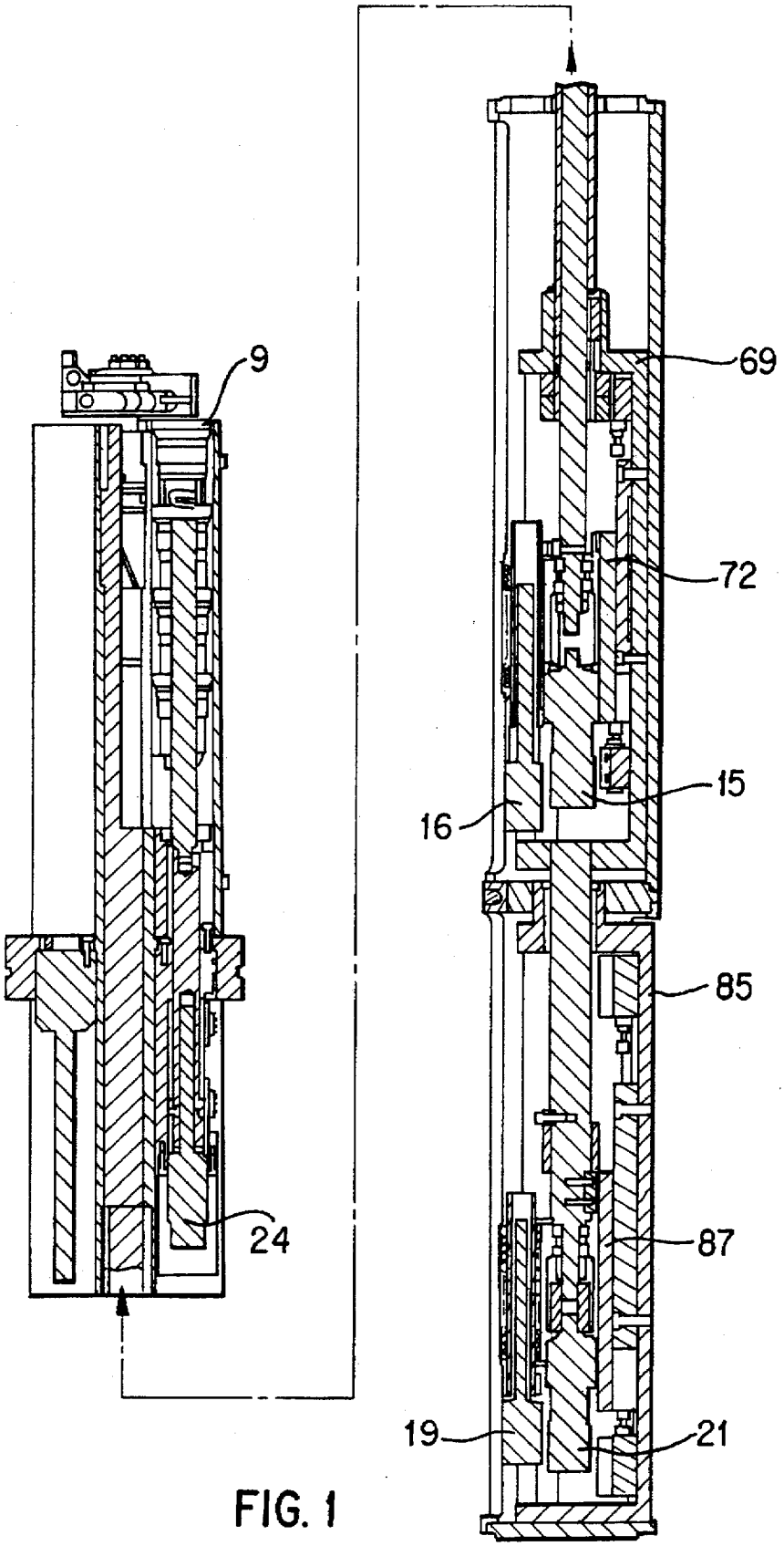
FIG. 1 is a cross-section view of the preferred embodiment of the present invention.

Referring to FIG. 1, the Articulated Bit-Selector Coring Tool (ABCT) of the present invention takes core samples of earth formations traversed by a borehole using cutting bits to cut the core samples. The ABCT is a multiple bit tool which can hold a large number of cutting bits. The cutting bits are of various types for cutting various formation materials. A specific cutting bit is selected, depending on the type of formation to be sampled. This tool has several motors that control the various movements of the tool.

Figure 2:
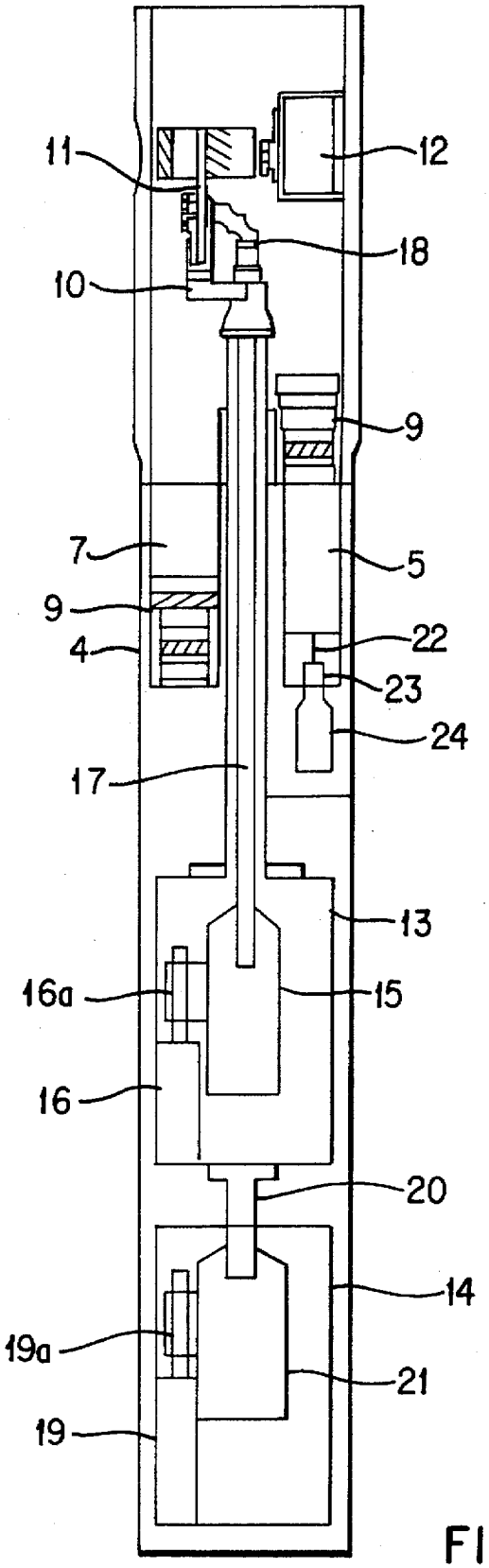
FIG. 2 is a diagram of the present invention.
Figure 3:
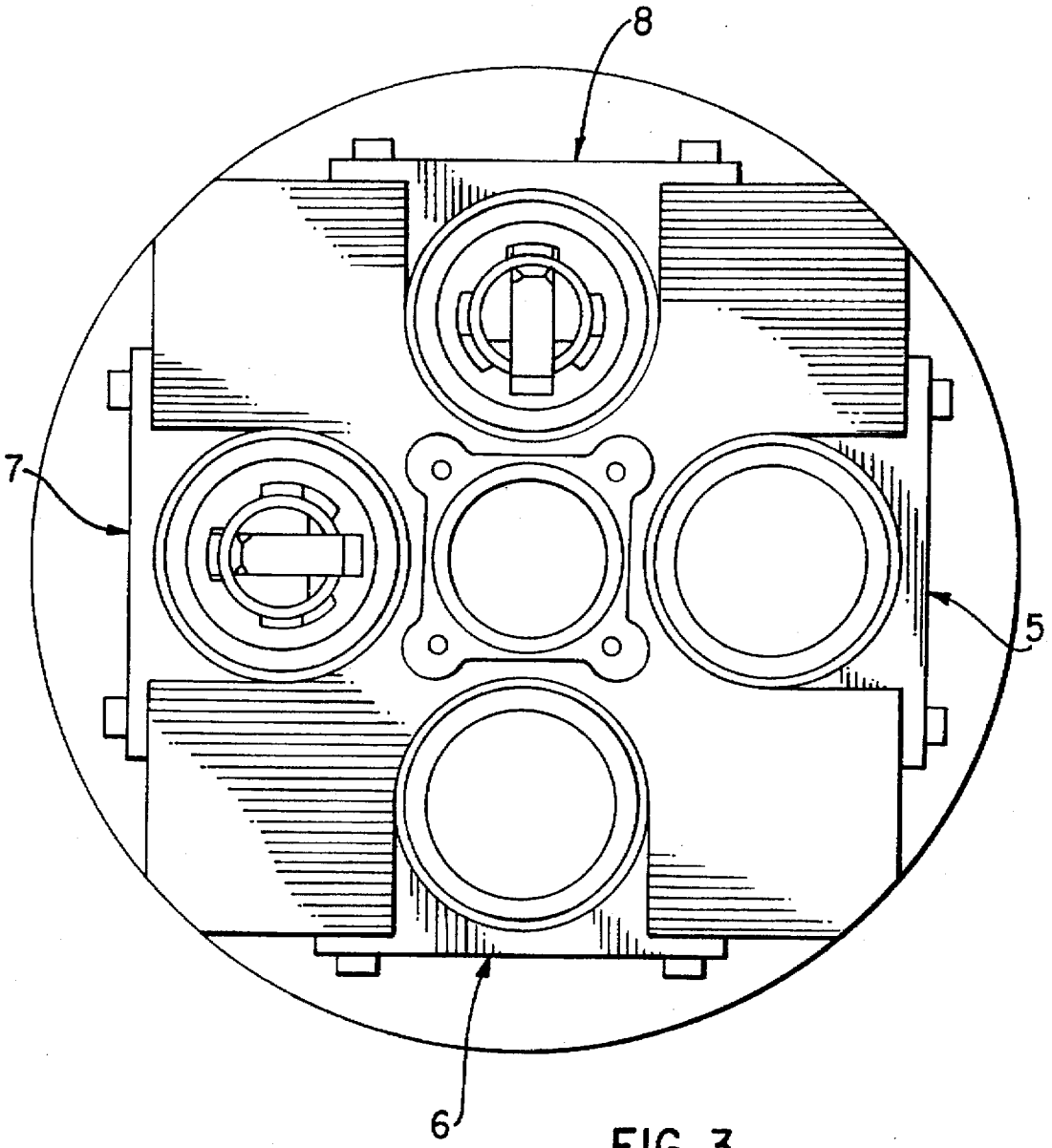
FIG. 3 is a top view of the chambers used to hold cutting bits prior to using the bits and to store cutting bits after use of the bits.

Referring to FIG. 2, these cutting bits are loaded into two separate holding chambers 5 and 6 (chamber 6 not shown in FIG. 2) and stored in two separate storage chambers 7 and 8 (chamber 8 not shown in FIG. 2). FIG. 3 shows a top view of the positions of the holding and storage chambers. Holding chambers 5 and 6 contain the multiple cutting bits prior to taking the formation core samples and storage chambers 7 and 8 store cutting bits 9 containing the formation core samples. In FIG. 2, the cutters in each holding chamber are positioned in the chambers, such that the cutting edge of the bit faces upward, by two separate motor driven core drive shafts 22 which are precisely indexed to force each bit upward to a ready position.

Referring to FIG. 2, once a cutting bit 9 is in the ready position, a gripper device, having a motor driven arm 10 and gripping rods 11, securely grips the ready cutting bit and positions the bit 9 horizontally in front of a bit gear drive 12 and perpendicular to the wall of the borehole traversing the earth formation. The bit gear drive 12 engages the cutting bit 9 and begins the process of drilling a core sample from the earth formation.

Figure 7:
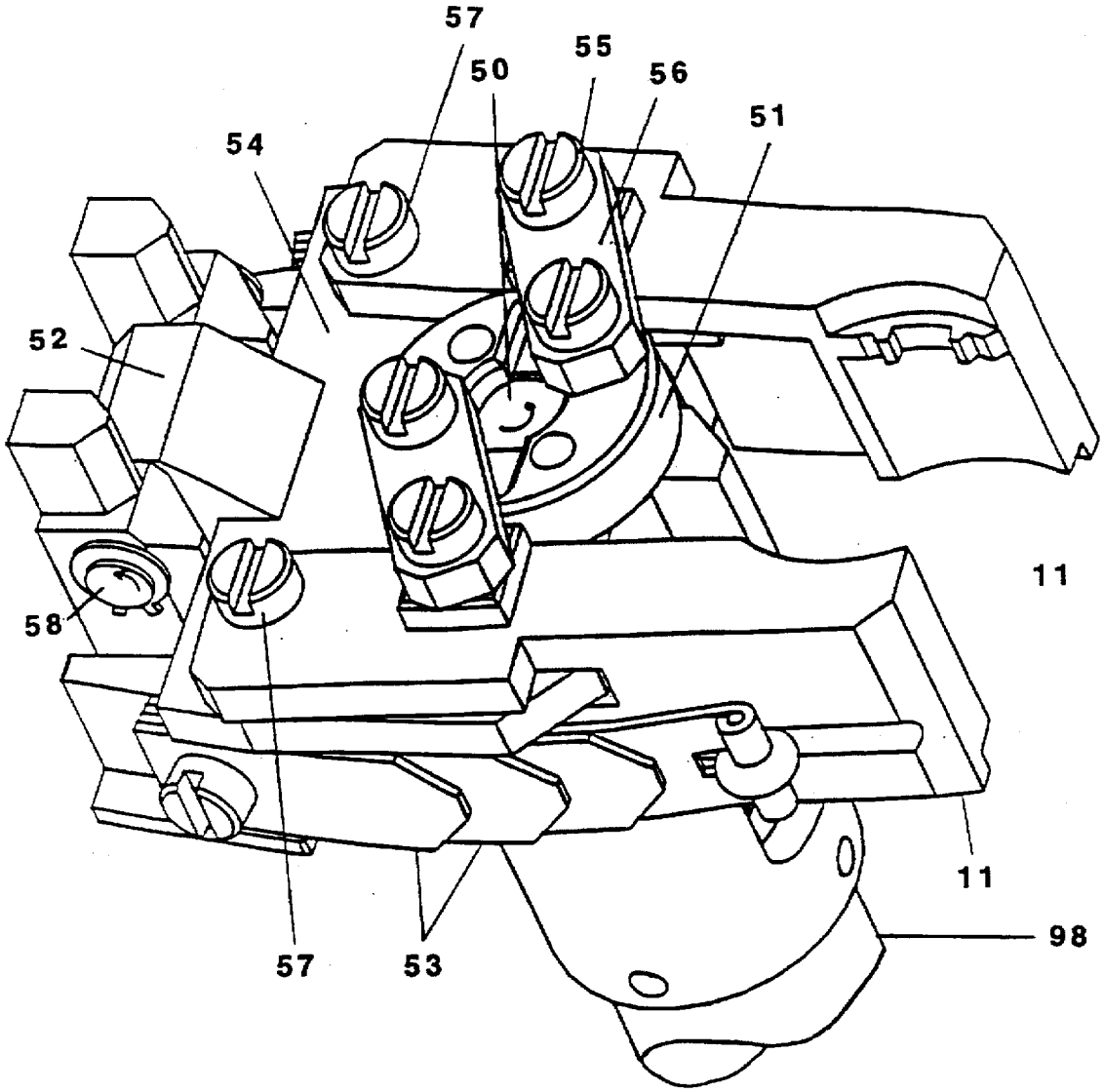
FIG. 7 is a isometric view of the gripper device.

The multiple bit tool of the present invention will have two sections that will be referred to as the upper section 13 and the lower section 14. Each section has two motors that control various operations of the tool. The upper section of the tool 13 contains the motors 15 and 16 that control the gripper device. The first of these motors is the upper torque motor 15. This motor, which comes equipped with angularity sensors and a motor off brake, controls the circular movement of an inner shaft 17. The gripper device is attached to this inner shaft 17 through a universal joint 18. Rotation of the inner shaft 17 causes the gripper rods to move inward and outward (as shown in FIG. 7 and will be discussed in detail later) for gripping and releasing cutting bits. A second motor located in the upper section of the tool is the upper translational motor 16. This motor controls the vertical movement of the inner shaft 17. Attached to the upper end of the inner shaft 17 is a universal joint 18 that translates the vertical motion of the inner shaft caused by motor 16 into a vertically circular motion of the gripping device about arm pivot 10 shown in FIG. 2, thereby causing the cutting bit to be lifted out of a holding chamber 5 and rotated (flipped) 90 degrees so that the cutting edge of the bit faces the wall of the formation.

A third motor, located in the lower section 14 of the tool, is the lower translational motor 19. This motor controls vertical movement of the entire upper section 13 of the tool. This motor 19 has a shaft 19*a* that is coupled to the housing of lower torque motor 21. As motor 19 rotates, shaft 19*a* causes motor 21 and its directly coupled shaft 20 to move in a vertical direction. The other end of shaft 20 is attached to the upper section 13 of the tool. Therefore, the vertical movement of shaft 19*a* will result in the same vertical movement of the entire upper section 13 and the gripping device. This movement of the upper tool portion enables the cutting bit 9 to be aligned with and engaged by the bit gear drive 12.

The fourth motor, located in the lower section 14 of the tool, is the lower torque motor 21 which also comes equipped with angularity sensors and a motor off brake. The rotation of this motor causes the arm 10 and gripper device holding the cutting bit containing the newly cut core sample to rotate circularly, so that the cutting bit is aligned with either the core storage chambers 7 and 8 or cutting bit holding chambers 5 and 6. This alignment enables the gripper device to drop the loaded cutting bit into one of the storage chambers or select a cutting bit from either of two holding chambers. The shaft 20 is rotated by the lower torque motor 21 causing the upper section 13 attached to the shaft to rotate and thereby enable components of the upper section, especially the gripper device, to rotate as necessary to retrieve and discard cutting bits and to angularly position cutting bits for drilling.

Figure 4:
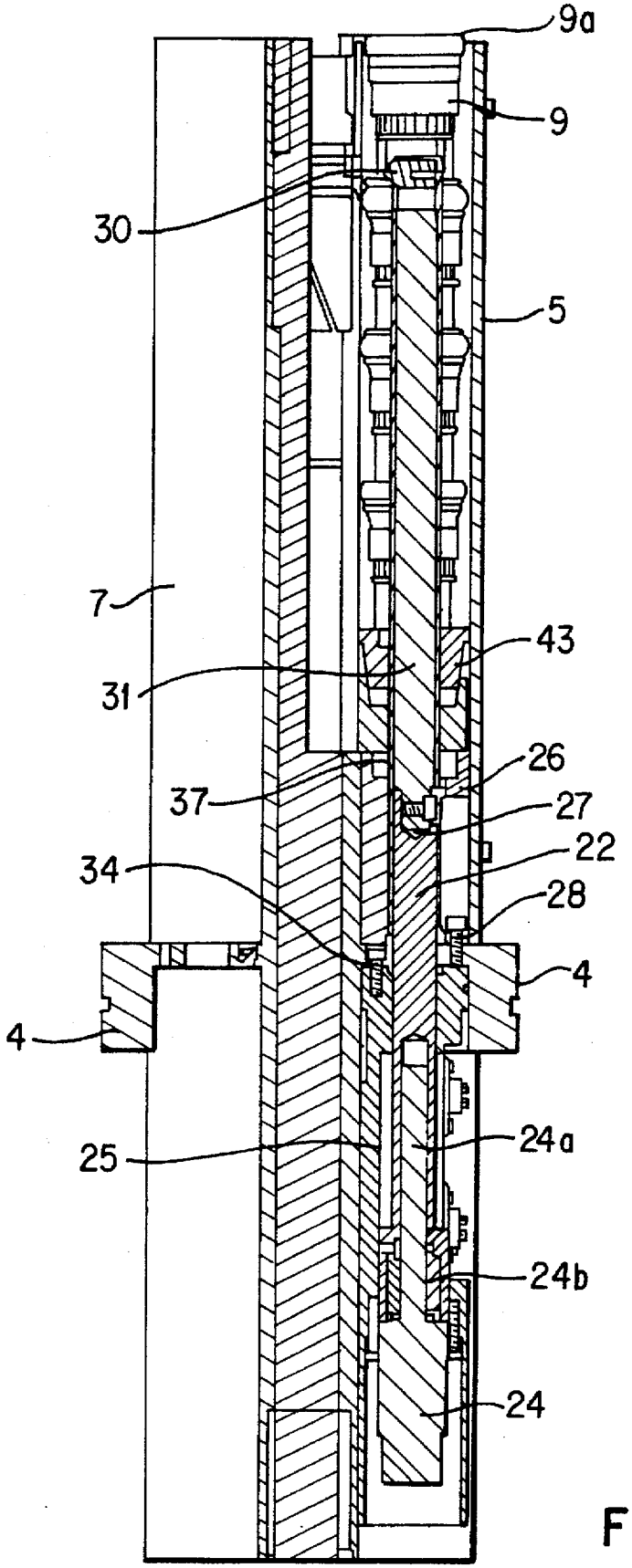
FIG. 4 is a cross-section view of the cutter bit feed and storage mechanism.
Figure 5A:
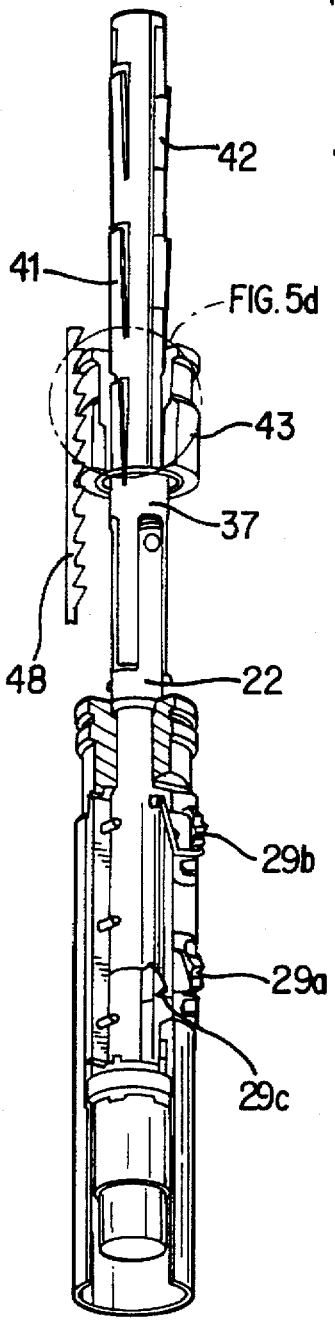
FIG. 5*a* is an isometric view of the cutter bit feed mechanism.

The cutting bits are fed to the gripper device in FIG. 6 through a feed mechanism in FIG. 4. As shown in FIG. 4 all cutting bits 9 are nested and stacked in a holding chamber 5 for use during the coring process. These cutting bits are stacked on top of a core shuttle 43 which is a ratcheted sliding block as shown in FIG. 5*a*. This core shuttle shuttles the cutting bits to the top of a holding chamber for use in the coring process. The core shuttle is moved upward a specific distance by leaf spring (pawls) 41. These springs are cut out of a shuttle core tube 37 which passes through the inner diameter of the core shuttle. This shuttle tube can be made of titanium. The pawls 41 engage the core shuttle on the upward motion, but flex out of the path on the downward motion leaving the shuttle in the up position as shown in FIG. 5*d*. The core shuttle is prevented from moving downward by a spring load stylus in a linear rack 48. A latch 30 (see FIGS. 5*b* and 5*c*) engages the inner lip of the top cutting bit as it moves upward and holds the bit steady until it is secured by the gripper rods. The latch releases the bit during the downward motion and engages the next cutting bit from the top of the stack in the holding chamber. The core shuttle 43 is moved by the action of a core drive shaft 22 which moves the drive shaft extension 31 and toggles the latch 30 then moves the shuttle tube upward. The core drive shaft 22 is attached to an integral cutting bit drive motor 24. The cutting bit feed mechanism is driven by this cutting bit drive motor. This motor turns the lead screw 24*a* which moves the core drive shaft 22 in an upward direction.

This cutting bit feed mechanism is illustrated in detail in FIGS. 4, 5*a*, 5*b* and 5*c*. As shown in FIG. 4, the holding chamber 5 contains a cutting bit drive motor 24 to drive the cutting bits in the chamber to the top of the chamber to be used for cutting core samples. In the present embodiment, each holding chamber will contain a cutting bit drive motor 24 and a lead screw portion 24*a* extending upward from its gearhead. The lead screw drives the lead screw nut 24*b* secured to drive shaft 22 and is prevented from rotation by a lead screw bracket 25. The lead screw bracket is attached to the tool housing 4 with 3 bolts 34. This feed section is designed in two portions to provide ease of maintenance and to enable cutting bits to be loaded into the holding chambers with little difficulty. A drive shaft extension 31 is attached to the core drive shaft 22 with a drive shaft adapter 27. An access spacer 26 provides a means to attach and detach the two portions of the feed device. As shown, the access spacer 26 is attached to the tool housing 4 by 3 bolts 28. To detach the upper and lower portions of the feed device, the plurality of bolts 28 are removed, then the top portion of the device can be remove.

FIG. 5*a* shows the feed device as the core shuttle 43 travels toward the top of the shuttle tube 37. The movement of the shuttle rod is controlled by limit switches 29*a* and 29*b*. Before the shuttle begins movement, limit switch 29*a* activates the motor 24 causing the drive shaft extension 31 and shuttle core tube 37 to move in an upward direction. The upward movement of the extension shaft 31 raises a pressed pin 39 in the extension shaft causing the latch 30 to pivot about pin 38 fixed in the core tube. This rotation shown in FIG. 5*c* causes the chamfered flank 30 of the latch to engage the internal lip 36 of the top core cutter securing it so it will not fall when it is moved out of the holding chamber. When this occurs, the open blunt end of the core tube leaf spring, acting as pawls, runs into the inner shoulder of the core shuttle 43 located at the base of the stack of core cutters (see FIGS. 5*a* and 5*d*). With the core cutters now secured between the toggled latch at the top and the core shuttle at the bottom, the entire assembly continues to move upward until the upper most core cutter reaches the ready position. At this point, limit switch 29*b* is activated shutting down the motor causing the assembly to come to a stop. The assembly remains at rest until the gripper device secures the upper most core cutter in its jaws. At this point, the motor 24 is activated in the reverse direction lowering the core shuttle drive shaft and extension shaft.

Figure 5B:
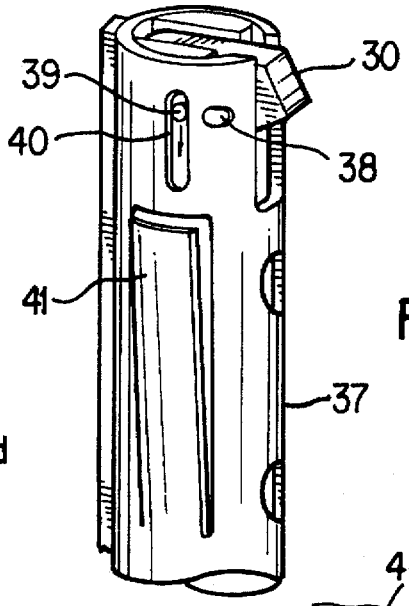
FIG. 5*b* is a view of the spring and latch system for the feed mechanism.

This action as shown by the arrows in FIG. 5*b* causes, the toggle latch 30 to rotate to the straight up position releasing the core on top and allowing the latch to pass through the top core cutter as pin 39 moves to the bottom of the core tube slot 40. As the motor continues to run in reverse, the extension shaft pin 39 now at the bottom of the slot 40 pulls the core shuttle tube 37 down. The leaf spring pawls of the core tube flex inward as the springs pass through the inner shoulder in the core shuttle 43. The core shuttle is prevented from downward movement by such means as a ratcheted spring pawl emanating from the core shuttle engaging a linear gear tooth rack 48. Immediately after the leaf spring of the core shuttle tube passes the shoulder of the shuttle, the limit switch 29*a* is activated to shut down the motor. The shuttle is now positioned on the core tube pawls above the previous set. As seen by this description, the core shuttle and the core cutters stacked on top of it can only travel upward a predetermined amount for every cycle between the limit switches activated by a cam off the drive shaft 22.

Figure 5C:
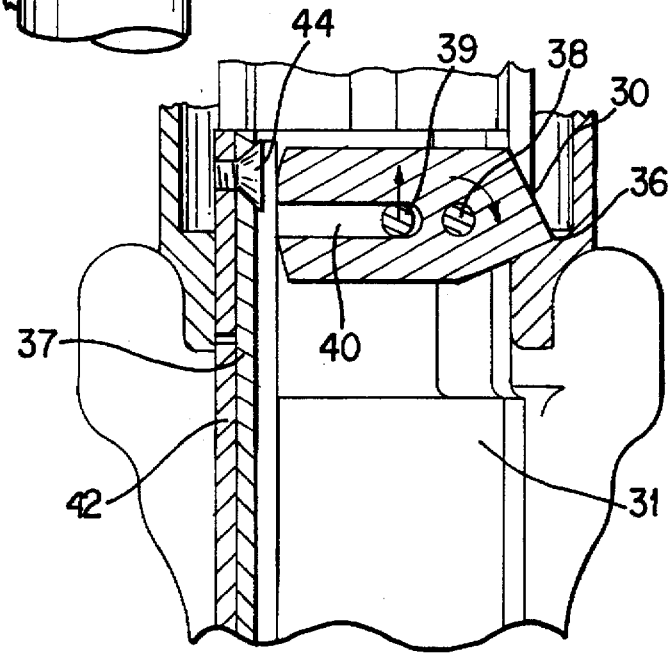
FIG. 5*c* is a cross-section view of the latch.
Figure 5D:
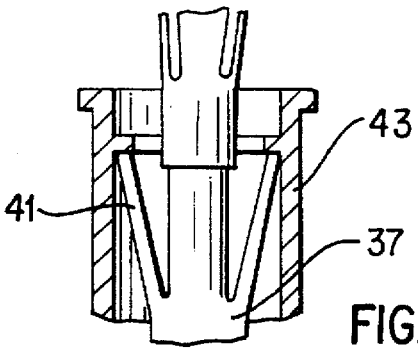
FIG. 5*d* is a closup view of the core shuttle, core tube and leaf pawls.

A core shuttle spine 42 is also attached to the shuttle tube 37 with screws 44. These screws are installed from the inside of the shuttle tube as shown in FIG. 5*c*. This spine which fits in a groove of this cutting bit is used to designate and maintain the orientation of the cutting bits. The spine groove in the cutting bit is used to identify the top side (or bottom side as desired) of the core as it is taken from the formation. The hollow cutting bit cuts the formation away around the core without rotating the actual core. The core can be broken using existing techniques. Prior to breaking off the core from the formation, the cutting bit is rotated to put the spine groove in the up position (or down position). Since the core is always contained in the cutting bit after completion of the coring process, the spine groove therefore indicates the top side of the core. The cores can be taken to the lab for analysis as the cores were when broken off from the formation inside the cutting bit housing. This feature is facilitated by the design of the cutter bit which allows easy removal of the cutting head for rescue, releasing the cutter body containing the core intact for lab analysis as shown in FIG. 4.

The cutting bit feed device positions a cutting bit 9 at the top of the holding chamber 5 for the gripper device to take and align for engagement by the cutting bit gear drive 12 (see FIG. 2). The gripper device as shown in FIGS. 6*a*–6*e* and 7 can circularly rotate both vertically and horizontally as needed to align the cutter with the gear drive. The main feature of the gripper device is a pair of gripper arms 11. These arms actually grip and hold the cutting bits. The gripper arms inner surface is slightly concave to provide a better fit when the gripper holds the cutting bit. The gripper arms are attached to a gripper bracket 54. The gripper bracket shown in FIG. 6*a* has a pivot block portion 52 that enables the bracket to rotate vertically. Attached to the gripper bracket is an actuator disc 51 shown in FIG. 6*b*. A groove 59 is contained in the actuator disc 51. The gripper bracket 54 and disc 51 sit on the stationary drive arm 10 which houses the universal joint 18. As shown in FIG. 6*c*, this disc 51 is designed such that a threaded ball joint 49 fits into it. This ball joint contains a pin rod 50 that fits into a groove 59 in the actuator disc 51. The threaded ball joint 49 is the upper part of the universal joint 18. This ball joint is held in place by the adapter portion 48 of the universal joint. As stated previously, the universal joint 18 is attached to the inner shaft 17. As shown in FIG. 6*d*, as the inner shaft 17 rotates, the universal joint translates this circular motion to the threaded ball joint 49 and therefore to the pin rod translates this circular motion to the threaded ball joint 49 and therefore to the pin rod 50. The pin rod applies a torque against groove 59 of the actuator disc 51 causing the disc to turn.

Figure 6A:
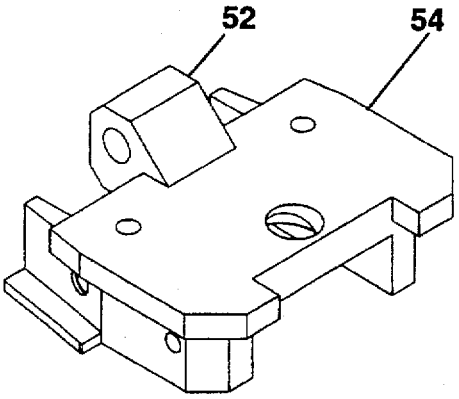
FIG. 6*a* is a view of the gripper bracket.
Figure 6E:
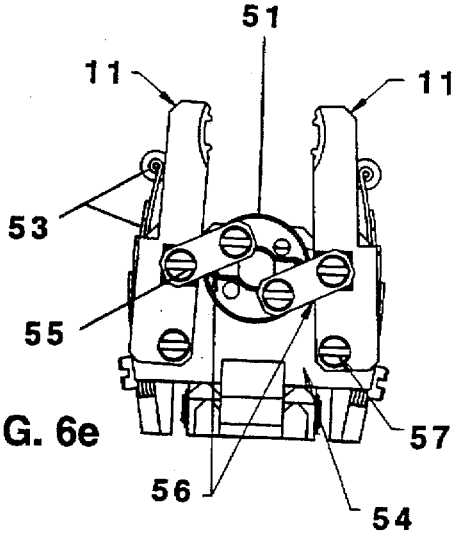
FIG. 6*e* is a top view of the gripper device.
Figure 6B:
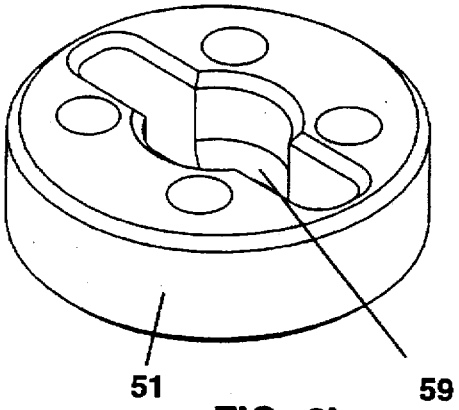
FIG. 6*b* is a view of the arm actuator disc.
Figure 6D:
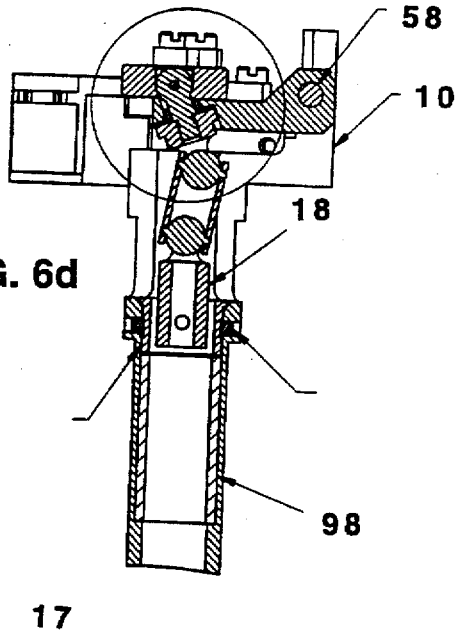
FIG. 6*d* is a cross-section view of the attachment of the inner and outer shafts to the gripper device.
Figure 6C:
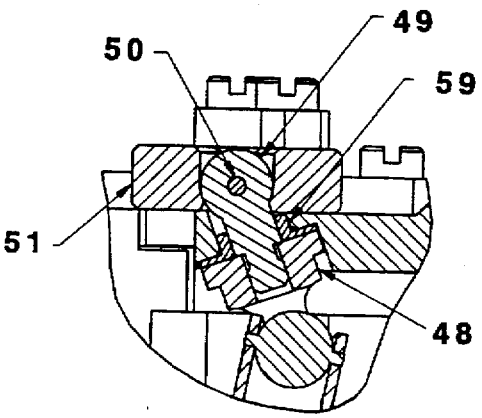
FIG. 6*c* is a detailed cross-section view of the attachment of the inner shaft to the gripper device.

Referring to FIG. 6*e*, arm actuator links 56 attach the arm actuator disc 51 to the gripper arms 11. Shoulder screws 55 attach the arm actuator link 56 to the arm actuator disc 51 and to the gripper arms 11. As the actuator disc rotates, the arm actuator links exert force on the gripper arms 11. Rotation of the disc in one direction causes the gripper arms to expand outward and rotation in the opposite directions cause the gripper arms to contract inward. An outward force by the actuator links cause the gripper arms to pivot around pivot pins 57, which attach the gripper arms to the gripper bracket, this causes the arms 11 to move in an outward direction. As the gripper arms move in an outward direction, stabilizer springs 53 attached to the gripper arms exert a force in an inward direction against the gripper arms. The force of the springs 53 is not as great as the outward force exerted by the arm actuator link, therefore the gripper arms will be able to open as desired. However, the inward force of the springs serve to stabilize the gripper arms during outward movements. The stabilizer springs 53 also force the gripper arms back to the original gripper arm positions when the gripper arms release the cutting bit and the actuator disc is rotated inward. The stabilizer springs also secure the core cutter while the gripper mechanism is rotated (flipped 90°) for positioning the cutters to coring position. This stabilization is important, since there can be no torque on the universal joint during this motion.

Figures 10A, 10B, 10C, 10D:
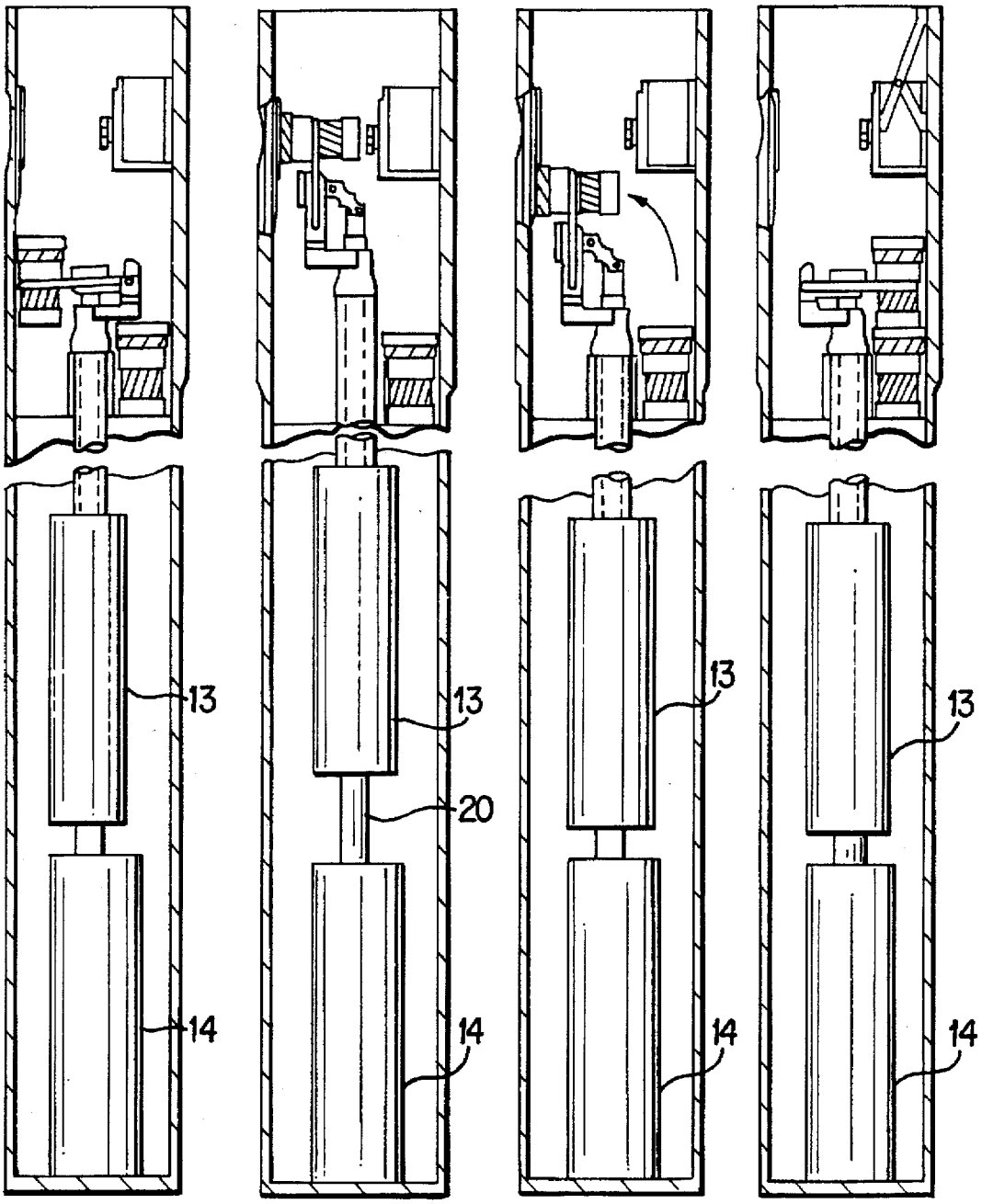
FIG. 10*a* is a view of the invention in the position as a core drill bit is being taken from the core bit feed mechanism.
FIG. 10*b* is a view of the invention in the position as the core drill bit is being flipped (rotated 90 degrees) so that the cutting edge of the bit faces the formation.
FIG. 10*c* is a view of the invention in the position as the core drill bit is being raised to align the core drill bit with the cutting gear in order to drill into the formation.
FIG. 10*d* is a view of the invention in the position as the core drill bit is being dropped into one of the drill bit storage chambers.

The gripper device can be rotated vertically (flipped 90°) by moving the inner shaft 17 vertically. The vertical rotation of the gripper device positions the cutting edge of the cutting bit such that it faces the formation surface to be cut. The vertical rotation of the gripper is shown in FIG. 10*b*. As shown in FIG. 6*d*, the inner shaft 17 moves in an upward direction causing the universal joint 18, pivot block 54 and disc 51 to move vertically in a 90° arc about pivot pin 58. The universal joint 18 is articulated to provide the gripper its 90° rotated position. To accomplish this total rotated 90° angle position, the universal and ball joint drive can be preset so that the maximum angle for transmitting torque through each joint does not exceed 35° off straight line drive. The stationary drive arm 10 and outer shaft extension 98 act as a base for the circular movement of the gripper mechanism and therefore requires the pivot block 52 to rotate around pivot pin 58 as the inner shaft moves upward. The rotation of the pivot block causes the gripper device that is attached to the pivot block to rotate thereby rotating the cutting bit held by the gripper arms. FIG. 7 shows a isometric view of the gripper device attached to the universal joint.

Figure 8:
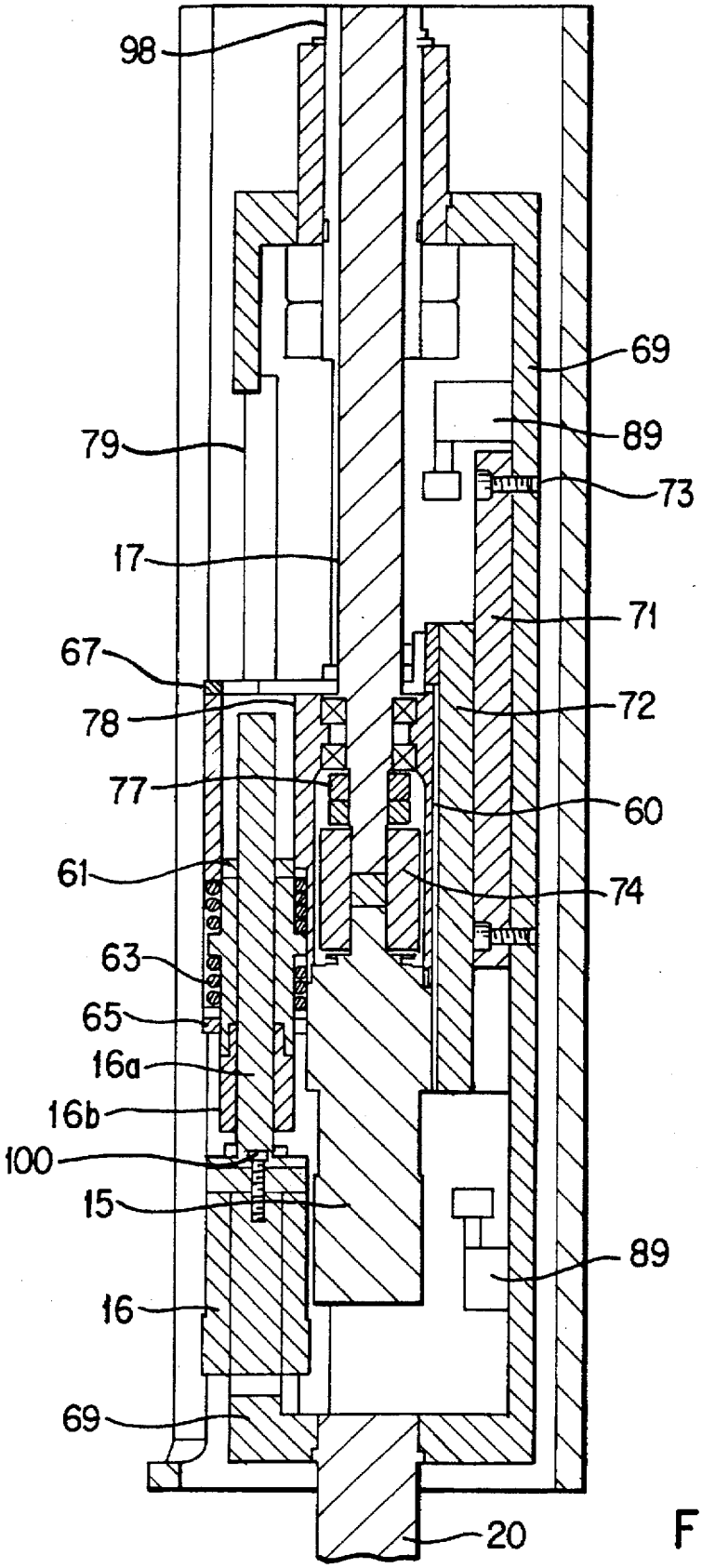
FIG. 8 is a cross-section view of the gripper motor drive assembly.
Figure 9:
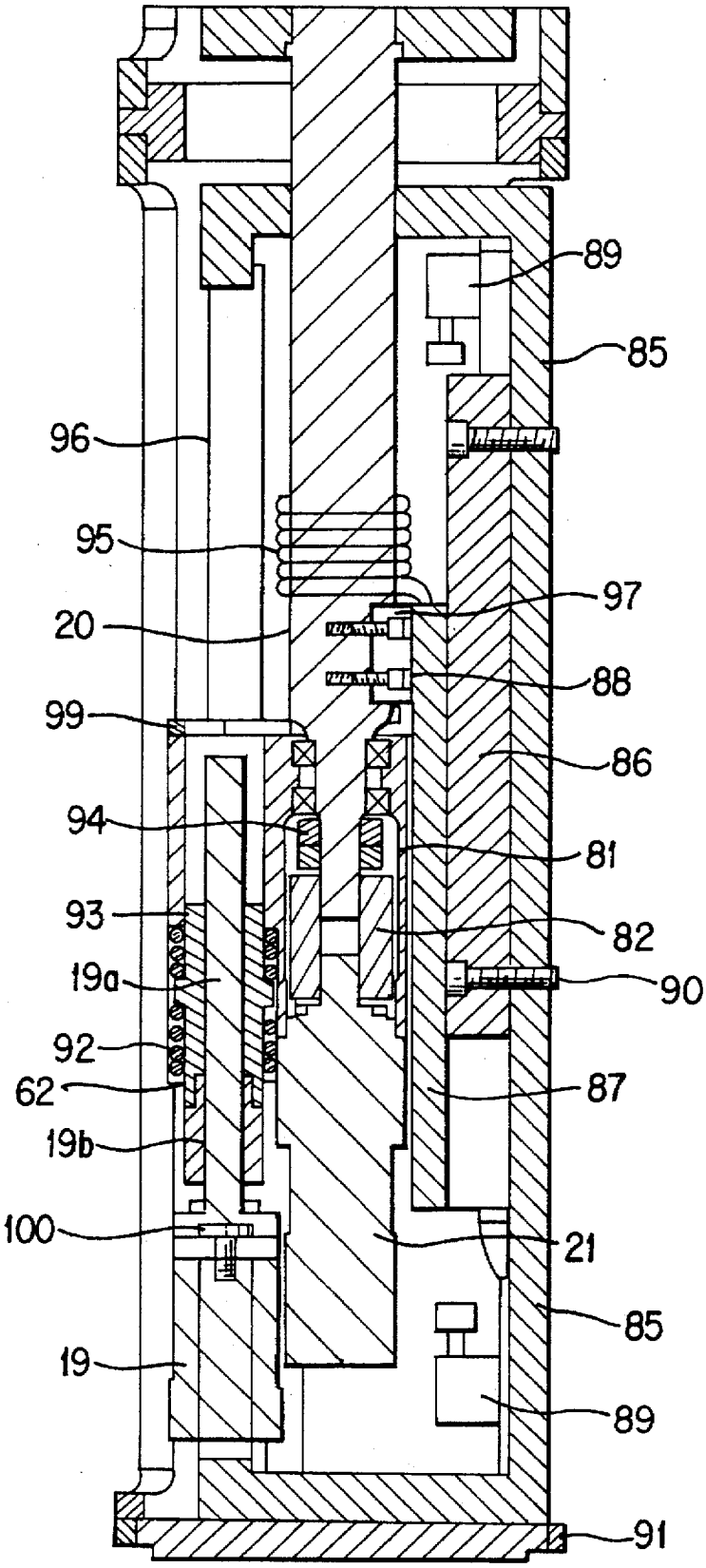
FIG. 9 is a cross-section view of the lower drive section of the invention.

Circular rotation of the gripper device about the tool axis is accomplished by rotating the drive arm 10, which is attached to the outer shaft extension 98 of the upper section bracket 69 as shown in FIGS. 6*d* and 8. The upper section bracket 69 is rotated by torque motor 21 coupled to the lower drive shaft 20. As shown in FIG. 9, the lower drive shaft is in turn welded to the lower end of bracket 69. As the drive arm 10 rotates so does the entire gripper device and pivot block 54 attached to it.

The movements of the gripper arms and the vertical rotation (flipping) movements of the gripper device are controlled by the inner shaft 17. As previously described, circular rotation of the shaft causes the gripper arms to move inward and outward to retrieve, hold and release cutting bits. The vertical movement of this shaft causes the gripper device to rotate in a vertical direction (flip 90°).

The inner shaft 17 that causes these movements is controlled by a pair of motors. The operation of these motors is illustrated in FIG. 8. Shown in FIG. 8, are the upper torque motor 15 and the upper translational motor 16. The upper torque motor is directly attached to the inner shaft 17 and controls the circular movement of the shaft. The vertical motion of the inner shaft is controlled by the upper translational motor 16. As shown in FIG. 8, a ball drive (lead screw) 16*a* forms the top portion of the upper translational motor 16 which is bolted to upper bracket 69. This lead screw screws into the lead screw nut 16*b* which is threaded into translator adapter 61. This translator drive adapter 61 is spring coupled to a motor mounting bracket 60. The motor mounting bracket 60 is also attached to upper torque motor 15. The motor mounting bracket 60 is also attached to a slide saddle 72 (see FIG. 8). This slide saddle enables the motor mounting bracket to move (slide) vertically with respect to upper section bracket 69. As the upper translational motor 16 rotates, the lead screw drive 16*a* rotates engaging the lead screw nut 16*b* threaded into translator drive adapter 61. As shown, the lead screw nut 16*b* and drive adapter 61 are threaded together. The adapter 61 moves with the threads of the ball drive 16*a*, thereby causing the attached motor mounting bracket 60 and torque motor 15 to move in a vertical direction. As the upper torque motor 15 moves vertically, the inner shaft 17 attached to the upper torque motor moves vertically and thereby causes the gripper device to rotate in vertically 90°. Shock absorber springs 63 are positioned between the translator drive adapter 61 and the motor mounting bracket 60 in order absorb any shocks that may result when the inner shaft reaches the end of its stroke. These springs 63 are secured in place by translator spring preload cap 65.

The upper and lower sections of the tool, 13 and 14, both contain the motor assembly described in FIG. 8 and FIG. 9 respectively. Referring to the upper section 13, FIG. 8 shows an upper sectional bracket 69, supporting the assembly of the upper section 13. Attached to this bracket 69 is a slide mounting bracket 71. Screws 73 attach and hold the slide mounting bracket 71 to the upper sectional bracket 69.

Slidably attached to the slide mounting bracket 71 is the slide saddle 72. The slide bracket 71 acts as a frictionless guide for the slide saddle 72 when the inner shaft 17 is moved vertically. The slide saddle is attached to the motor mounting bracket 60 via adjustable alignment bracket 67 as shown in FIG. 8. Adjustable shock mounts 89 are located below and above the sliding mounting bracket 71 and slide saddle 72. These shock mounts serve to stop the slide and serve to reduce any shock from the stop. A coupling 74 couples the upper torque motor 15 to the inner shaft 17.

The upper translational motor 16 is attached to the upper sectional bracket 69 with motor flange screws 100. As previously described, as the motor 16 turns the lead screw, the drive adapter 61 moves in a vertical direction. As the adapter moves vertically, the motor bracket 60, inner shaft 17 and upper torque motor 15 all move vertically with respect to the upper translational motor 16 and the upper motor mounting bracket 69 guided by the slide saddle 72. A linear transducer, such as a potentiometer not shown, connected between the motor bracket 60 and motor mounting bracket 69 continually monitors this translation. Radial ball bearings 78 are used to control rotational movements of the shaft 17. Since sectional bracket 69 does not completely encircle the upper section motors, a stabilizer bar 79 is used to span the opening to provide maximum rigidity to the upper section bracket 69.

The lower section of the tool 14 also contains an assembly similar to the previously described motor assembly. Referring to the lower section 14 in FIG. 9, a lower sectional bracket 85, supports the assembly of the lower section 14. Attached to this bracket 85 is a slide mounting bracket 86. Screws 90 attach and hold the slide mounting bracket 86 to the sectional bracket 85. Slidably attached to the slide mounting bracket 86 is the slide saddle 87. The slide bracket 86 acts as a guide for the slide saddle 87 when the lower drive shaft 20 is moved vertically. The slide saddle 87 is attached to the motor mounting bracket 81 via adjustable alignment bracket 99 as shown in FIG. 9. A coupling 82 couples the lower torque motor 21 to the lower drive shaft 20. Screws 88 attach a stop block 97 to the shaft 20. The stop block restricts the rotation of shaft 20 to 270° by impinging on the motor mounting alignment bracket 99. There is also a coil spring 95 around shaft 20 to insure a constant restoring torque opposing the torque of the lower torque motor 21.

The lower translational motor 19 is attached to the lower sectional bracket 85 with screws 100. A shaft **19*a* attached to the lower translational motor 19 engages motor nut 19*b* which is threaded into the drive adapter 93. The translator drive adapter 93 is spring coupled to the motor mounting bracket 81 and are secured in place by translator spring preload cap 62. These springs 92 are positioned between the drive adapter 93 and the motor mounting bracket 81. As the motor 19 turns the lead screw, the drive adapter 93 moves in a vertical direction. As the adapter moves vertically, the motor bracket 81, lower drive shaft 20 and lower torque motor 21 all move vertically guided by the slide saddle 87 with respect to the lower translational motor 19, the lower sectional mounting bracket 85 and slide mounting bracket 86. A linear transducer, such as a potentiometer (again not shown) connected between the motor bracket 81 and the lower mounting bracket 85 continuously monitors this translation. Adjustable shock mounts 89 are located below and above the sliding mounting bracket 86 and slide saddle 87. These shock mounts serve to stop the slide and serve to reduce any shock from the stop. Coil springs 95 are used to stabilize and control circular movement of lower drive shaft 20. Since the sectional bracket 85 does not completely encircle the lower section motors, a stabilizer bar 96 is used to connect the upper and lower ends of the bracket 85 to increase overall stiffness of the assembly. The lower section 85 is attached to base of the tool 91**.

The sequence of operation of the invention is illustrated in FIGS. **10*a*, 10*b*, 10*c* and 10*d*. During the operation of the multiple bit coring tool of the present invention, cutting bits are initially placed in the two holding chambers 5 and 6 shown in FIG. 3. The cutting bit drive motor 24, shown in FIG. 4, is activated and lead screw 24*a* moves the core drive shaft 22 and drive shaft extension 31 upward. This action rotates the toggle latch 30 against the inner lip of the top core cutter securing it tightly into the mouth of the core cutter below it as shown in FIG. 5*c***.

Referring to FIG. **5*a*, when the top core cutter is secured the core shuttle tube 37 now moves upward allowing the lower most pair of leaf spring pawls 41, cut out of the tube, to engage the inner lip of the core shuttle 43 on which all the core cutters are stacked. As the lead screw 24*a* continues to turn the leaf spring pawls lift the core shuttle and hence all cores stacked (one inside the other) on the core shuttle manifold until the top core cutter reaches ready position. At this point, a limit switch 29*b* is activated by a cam 29*c* on the core drive shaft shutting off the motor 24**.

Positioned directly over the loaded core cutter chamber is the gripper arm assembly shown in FIG. 6. As the core cutter is moving up to ready position, the upper torque motor 15 then turns on opening arms 11 against leaf springs 53 allowing the core cutter to pass inside the arms. The motor 15 then turns off thereby setting the motor brake. Leaf springs 53 clamp the cutting bit in the gripper arms 11 as shown in FIG. **10*a*. The core bit motor 24 reverses, retracting the extension shaft 31. In FIG. 5*b*, the bit latch 30 disengages and secures the next cutter in the holding chamber 5**.

The upper translation motor 16 is activated creating a vertical movement of the inner shaft (see FIG. 2). This movement of the inner shaft 17 causes the gripping device to rotate upward, thereby flipping the cutting bit to a horizontal position as shown in FIG. **10*b*. In this horizontal position, the cutting side of the cutting bit now faces the formation to be sampled. The opposite side of the cutting bit faces the coring bit gear drive 12. The lower translation motor 19 is next activated and begins to move the cutting bit upward to a loading position in front of the gear box 12 as shown in FIG. 10*c*. A linear drive motor (not shown) activates the kinematics enabling the gear drive to move toward and engage the cutting bit. The gearmotor prior to engaging and disengaging the cutting bit is rotated to a preset angularity as indicated by a sensor. The gearmotor engages and disengages the cutting bit by means of a J-slot with a overriding spring dedent retainer. As the gear drive engages the cutting bit, the torque motor 15 activates tightening the gripper arms 11 around the cutting bit to secure the bit in the engaging process. After the cutting bit is engaged by and secured to the gear drive, the gripper torque motor opens the gripper arms, then shuts down thereby setting the motor brake. Then the arm translation motor 19** reverses thereby lowering the gripper device to allow coring to begin. After the cutting bit has reached core depth and prior to braking off the core, the geardrive rotates the cutting bit a its preset angularity with core cutter spine groove in the uphole (or downhole) position.

After the coring process is complete, the lower translation 19 motor raises the gripper device to retrieve the cutter containing the formation core. The upper torque motor is activated causing the gripper arms to clamp on the cutting bit as the drive motor disengages from the cutting bit. The upper torque motor shuts off to set the brake. The lower translation motor 19 lowers the gripper device containing the core ladened cutting bit for deposit into a storage chamber 7. The lower rotation motor 21 positions the gripper device horizontally by rotating the gripper device containing the core ladened cutting bit over the core position sensor (not shown). The upper translation motor rotates the cutting bit to a vertical position with the non-cutting end down. The lower translation motor lowers the cutting bit onto a core position sensor to check the length of the formation core. The core length is determined by recording the linear transducer of lower section 14 as the core position sensor contacts the core after entering the non-cutting end of the core cutter. The arm translational motor raises the bit off the sensor. The lower rotation motor rotates the cutting bit to the core storage chambers 7 or 8. The lower translation motor lowers the cutting bit into the receiving storage chamber which secures the bit as shown in FIG. 10*d*. Finally, the upper torque motor opens the gripper arms releasing the cutting bit into the storage chamber. The lower rotation motor then rotates back to its home position.

The apparatus and method of this invention provides significant advantages over the current art. The invention has been described in connection with its preferred embodiments. However, it is not limited thereto. Changes, variations and modifications to the basic design may be made without departing from the inventive concepts in this invention. In addition, these changes, variations and modifications would be obvious to those skilled in the art having the benefit of the foregoing teachings. All such changes, variations and modifications are intended to be within the scope of the invention which is limited only by the following claims.

We claim:

1. A multiple cutting bit tool for cutting sample cores of an earth formation from a borehole traversing said formation wherein a different bit is used to cut and hold each core sample and wherein multiple core samples can be taken in one borehole run comprising:

a plurality of cutting bits each having a cutting axis and cutting edge for cutting core samples from said earth formation;

a means for holding said plurality of cutting bits before taking core samples, said holding means comprising at least two chambers, said chambers being approximately parallel to said borehole;

a means for storing said plurality of cutting bits after taking a formation core sample, said storing means comprising at least one chamber being approximately parallel to said borehole; and a drive means for engaging the cutting bit and causing the bit to cut a core sample.

2. The tool of claim 1 further comprising:

a means for positioning cutting bits in said holding means such that a cutting bit is always in position to be retrieved for use in the coring process; and a means for orienting a cutting bit such that the bit is aligned with said drive means for cutting a core sample.

3. The tool of claim 2 wherein the bit orienting means comprises:

a means for gripping a cutting bit;

a means for rotating said bit in a direction such that the cutting axis of said cutting bit is approximately perpendicular to the borehole wall; and a means for aligning the cutting bit with the drive means.

4. The tool of claim 3 wherein the gripper means comprises:

a gripper mounting bracket having a back and a front end and two sides;

gripper arms attached to each side of said gripper mounting bracket with, said gripper arms having inner and outer sides;

a drive plate attached to the front end of said gripper mounting bracket, said drive plate having top and bottom sides and having a groove therein and said drive plate also being able to rotate;

drive links attached to said drive plate and to the inner sides of said gripper arms such that when the drive plate rotates the drive links extort force on the gripper arms thereby causing the gripper arms to move in an outward direction; and a means attached to the gripper mounting bracket such that said means exerts force inward on the gripper arms.

5. The tool claim 4 wherein said means that exert an inward force on the gripper arms are springs biased to exert such force on the gripper arms.

6. The tool of claim 4 further comprising gripper pivot pins around which the gripper arms rotate when force is exerted on said gripper arms said pivot movement enables the gripper arms to respond to the exerted force causing the arms to move into position to grip, hold and release cutting bits.

7. The tool of claim 4 further comprising a ball joint, said ball joint having a linear extension, said linear extension being able to fit into a groove in the top side of the drive plate and thereby enabling the ball joint to rotate the drive plate.

8. The tool of claim 3 wherein the rotating means for said bit further comprises:

a pivot arm connected to the gripper means via a gripper mounting bracket for rotating said gripper arms, said bracket having a back and a front end and two sides and being attached to a ball joint comprising the top portion of a universal joint attached to an inner shaft;

an outer shaft connected to said pivot arm, said shaft supplying a torque to said pivot arm thereby forcing the gripper to rotate;

a pivot block forming the back portion of said gripper mounting bracket; and a pivot pin extending through said pivot block, said pivot pin enabling said pivot block to rotate around said pivot pin when force from said inner shaft is applied to said pivot arm.

9. The tool of claim 1 wherein each said holding chamber contains a different type of cutting bit.

10. The tool of claim 4 wherein said positioning means comprises:

a shuttle means having a hollow center, said shuttle means being in contact with said cutting bits;

a shuttle tube means having a top and bottom ends and extending through the center of said shuttle means; and a drive means in contact with said shuttle tube means for lifting said shuttle tube means and thereby lifting said shuttle means and cutting bits for positioning said cutting bits to be retrieved for use in the coring process.

11. The tool of claim 10 further comprising a latch positioned inside the top end of said shuttle tube means for securing said top cutting bit before said is retrieved for use in the coring process.

12. The tool of claim 10 wherein said drive means is attached to said shuttle tube means by a drive shaft.

13. The tool of claim 4 comprising a positioning means in each of said holding chambers.

14. A multiple cutting bit coring tool for cutting sample cores from an earth formation traversed by a borehole, said multiple cutting bits enabling multiple core samples to be taken in one borehole run comprising:

a) a plurality of chambers having upper and lower ends and used to hold and store cutting bits;

b) a drive mechanism that moves said cutting bits within said holding chambers in a direction that will allow said cutting bits to be used in the coring process;

c) a bit handling mechanism above said upper end of said holding chambers for retrieving a cutting bit from a stack of cutting bits in said holding chambers;

d) a cutting bit drive contained in said tool for engaging the cutting bit and causing the bit to cut a core sample.

15. The tool of claim 14 wherein said bit handling mechanism comprises:

a gripper device;

an inner shaft attached to said gripper device and used to enable said gripper device to retrieve, release and vertically and horizontally orientate said cutting bits; and an outer shaft attached to said gripper device to enable said gripper device to rotate a cutting bit to a position for engaging cutting bit drive.

16. The tool of claim 15 further comprising a shaft control mechanism to control movement of the inner and outer shafts.

17. The tool of claim 15 further comprising an upper section and a lower section, said upper section containing said drive mechanism, gripper device, inner and outer shafts and a shaft control means and said lower section of said tool containing a lower drive shaft and lower shaft control means with said lower shaft being attached to said upper section of said coring tool.

18. The tool of claim 16 wherein said shaft control mechanism comprises a series of electronic motors.

19. The tool of claim 18 wherein said inner shaft is moved in a direction to and from the gripper by an upper translational motor.

20. The tool of claim 18 wherein said inner shaft is moved in a circular direction by an upper torque motor.

21. The tool of claim 18 wherein said outer shaft is moved in a direction to and from the bit handling mechanism by said lower shaft connected to a lower translational motor.

22. The tool of claim 18 wherein said outer shaft is moved in a circular direction by a lower torque motor via said lower shaft.

23. The tool of claim 14 wherein the bit handling device comprises:

a mounting bracket having a back and a front end and two sides;

gripper arms attached to each side of said mounting bracket with, said gripper arms having inner and outer sides;

a drive plate attached to the front end of said mounting bracket, said drive plate having top and bottom sides with a groove in said top side and said drive plate being able to rotate;

drive links attached to said drive plate and to the inner sides of said gripper arms such that when the drive plate rotates the drive links extort force on the gripper arms thereby causing the gripper arms to move in an outward direction; and springs attached to the mounting bracket and biased such that the springs exert force inward on the gripper arms.

24. The tool of claim 23 further comprising gripper pivots around which the gripper arms pivot when force is exerted on said gripper arms enabling the arms to grip, hold and release cutting bits.

25. The tool of claim 23 further comprising a ball joint, said ball joint having a linear extension, said linear extension being able to fit into a groove in the drive plate and thereby enabling the ball joint to rotate the drive plate.

26. The tool of claim 23 wherein the bit handling device further comprises:

a pivot arm connected to the gripper means for rotating said gripper arms in a vertical direction;

an inner shaft connected to said pivot arm, said vertical shaft supplying a force to said pivot arm thereby forcing the gripper means in a direction such that a cutting bit axis is approximately perpendicular to the borehole wall;

a pivot block attached to the back portion of said mounting bracket; and a pivot pin extending through said pivot block, said pivot pin enabling said pivot bracket to rotate in a vertical direction around said pivot pin when force from said inner vertical shaft is applied to said pivot arm.

27. The tool of claim 17 wherein said inner shaft control means comprises an upper translational motor and an upper torque motor.

28. The tool claim 27 further comprising:

a mounting bracket in said upper section having a lower portion and side portion, said lower portion attached to said lower drive shaft and said upper translational motor; and a slide mechanism attached to said side portion of said mounting bracket, said slide mechanism enabling said inner shaft control means to move vertically with reference to said mounting bracket.

29. The tool of claim 28 wherein said slide mechanism comprises two rectangular shaped members, each said member having one side that is in slidable contact with said other member, one side of one said member also being attached to said mounting bracket and one side of the other said member also being attached to said inner shaft control mechanism.

30. The tool of claim 29 wherein said rectangular member that is attached to said inner shaft control mechanism further comprises a shock mount member attached to said inner shaft control mechanism, said shock mount member being able to restrict the sliding motion of said slide mechanism.

31. The tool of claim 29 wherein said rectangular member that is attached to said inner shaft control mechanism further comprises two stop members, one said member being attached to said mounting bracket above the slide mechanism and one said member being attached to said mounting bracket below said slide mechanism, said stop members being able to restrict the slide motion of said slide mechanism.

32. The tool of claim 2 further comprising:

a threaded stem attached to said upper translational motor;

a torque motor bracket mounted to said upper torque motor; and a circular longitudinal nut having and inner wall and an outer wall, said inner wall having screw threads for engaging said motor stem member and said outer wall being attached to said torque motor bracket, such that as said nut moves, said upper torque motor and said inner shaft move along with said nut.

33. The tool claim 17 further comprising:

a mounting bracket in said lower section having a lower portion and side portion, said lower portion attached to said lower translational motor; and a slide mechanism attached to said side portion of said mounting bracket, said slide mechanism enabling said lower shaft control means to move with reference to said mounting bracket.

34. The tool of claim 33 wherein said slide mechanism comprises two rectangular shaped members, each said member having one side that is in slidable contact with said other member, one side of one member being attached to said lower mounting bracket and the other side of other said member being attached to said lower shaft control mechanism.

35. The tool of claim 34 wherein said rectangular member that is attached to said outer shaft control mechanism further comprises adjustable shock mounts attached to said mounting bracket at both upper and lower ends of said slide mechanism to restrict the sliding motion of said slide mechanism.

36. The tool of claim 17 wherein said lower shaft control means comprises a lower translational motor and a lower torque motor.

37. The tool claim 36 further comprising:

a mounting bracket in said lower section having a lower portion and side portion, said lower portion attached to said lower translational motor and tool body; and a slide mechanism attached to said side portion of said mounting bracket, said slide mechanism enabling said lower shaft control means to move vertically with reference to said mounting bracket.

38. The tool of claim 37 wherein said slide mechanism comprises two rectangular shaped members, each said member having one side that is in slidable contact with said other member, one side of one member being attached to said mounting bracket and the other side of said member being attached to said lower torque motor mounting bracket.

39. The tool of claim 38 wherein said rectangular member that is attached to said inner shaft control mechanism further comprises a shock mount member attached to said inner shaft control mechanism, said shock mount member being able to restrict the sliding motion of said slide mechanism.

40. The tool of claim 36 wherein said lower translational motor further comprises a threaded stem member attached to said motor.

41. The tool of claim 40 further comprising:

a torque motor bracket mounted to said lower torque motor; and a circular longitudinal nut having and inner wall and an outer wall, said inner wall having screw threads for engaging said motor stem member and said outer wall being attached to said torque motor bracket, such that as said nut moves, said lower torque motor and said lower shaft move along the same direction as said nut.

42. The tool of claim 38 wherein said rectangular shaped member of said slide mechanism that is attached to said lower torque motor is attached via said torque motor bracket.

43. An apparatus for selecting a cutting bit from a plurality of cutting bits during the coring process of an earth formation traversed by a borehole comprising:

a means for holding a plurality of cutting bits before taking core samples, wherein said holding means comprises at least two holding chambers and said chambers being approximately parallel to said borehole;

a means for selecting a cutting bit from one of said holding chambers and positioning said selected cutting bit in relation to the earth formation for taking a core sample of the formation; and a means for storing a plurality of cutting bits containing earth formation core samples after taking said core samples, said storing means being a chamber approximately parallel to said borehole.

44. The apparatus of claim 43 further comprising a means for positioning cutting bits in said holding means such that a cutting bit in each holding chamber is in position to be selected for cutting a core sample.

45. The apparatus of claim 43 wherein the selecting and positioning means comprises:

a means for gripping a cutting bit;

a means for arranging said bit such that a cutting axis of said bit is approximately perpendicular to the borehole wall; and a means for aligning the cutting bit with a drive means that will provide the cutting motion that will enable said bit to cut a core sample.

46. The tool of claim 45 wherein the gripper means further comprises:

a gripper mounting bracket having a back and a front end and two sides;

gripper arms attached to each side of said gripper mounting bracket with, said gripper arms having inner and outer sides;

a drive plate attached to the front end of said gripper mounting bracket, said drive plate having top and bottom sides with a groove in said top side and said drive plate being able to rotate;

drive links attached to said drive plate and to the inner sides of said gripper arms such that when the drive plate rotates the drive links extort force on the gripper arms thereby causing the gripper arms to move in an outward direction; and a means attached to the gripper mounting bracket such that the means exerts force inward on the gripper arms.

47. The tool claim 46 wherein said means are springs biased such that the springs exert an inward force on the gripper arms.

48. The tool of claim 46 further comprising gripper pivots around which the gripper arms pivot when force is exerted on said gripper arms enabling the arms to grip, hold and release cutting bits.

49. The tool of claim 46 further comprising a ball joint, said ball joint having a linear extension, said linear extension being able to fit into a groove in the top side of the drive plate and thereby enabling the ball joint to rotate the drive plate.

50. The tool of claim 45 wherein the arranging means for said bit further comprises:

a pivot arm connected to the gripper means via a gripper mounting bracket for rotating said gripper arms in a vertical direction said bracket having a back and a front end and two side and being attached to said vertical shaft;

an outer vertical shaft connected to said pivot arm, said vertical shaft supplying a vertical force to said pivot arm thereby forcing the gripper means in a vertical direction;

a pivot block attached to the back side of said gripper mounting bracket; and a pivot pin extending through said pivot bracket, said pivot pin enabling said pivot block to rotate around said pivot pin when force from said vertical shaft is applied to said pivot arm.

51. The tool of claim 50 wherein the pivot block forms the back side portion of the mounting bracket.

52. An apparatus for retrieving a cutting bit from a plurality of cutting bits during and disposing of said bit after the coring process of an earth formation traversed by a borehole comprising:

a means for securing a cutting bit from a means for holding a plurality of cutting bits before taking core samples;

a means for positioning said bit in a direction such that the cutting axis of said cutting bit is approximately perpendicular to the borehole wall; and a means for aligning the cutting bit with a drive means such that said drive means can engage said cutting bit and cause said bit to cut a sample core.

* * * * *